US005598449A

United States Patent [19]

Yamazaki et al.

[11] Patent Number: 5,598,449

[45] Date of Patent: Jan. 28, 1997

[54] SYNTHESIS OF LABELED COMPOUND

[75] Inventors: Shigeki Yamazaki; Hideyuki Nakagawa, both of Tokyo, Japan

[73] Assignee: NKK Corporation, Tokyo, Japan

[21] Appl. No.: 378,949

[22] Filed: Jan. 26, 1995

Related U.S. Application Data

[63] Continuation of Ser. No. 955,749, filed as PCT/JP92/00003 Jan. 7, 1992, abandoned.

[30] Foreign Application Priority Data

Apr. 17, 1991 [JP] Japan ..... 3-085366
Apr. 17, 1991 [JP] Japan ..... 3-085367
Apr. 17, 1991 [JP] Japan ..... 3-085368

[51] Int. Cl.[6] ..... G21G 1/10

[52] U.S. Cl. ..... 376/195

[58] Field of Search ..... 376/195, 194

[56] References Cited

U.S. PATENT DOCUMENTS 4,752,432 6/1988 Bida et al. ..... 376/195

OTHER PUBLICATIONS

Int. J. Appl. Radiat. Isot., vol. 29, (1978), pp. 754–756, Parks et al.
Appl. Radiat. Isot. vol. 37, No. 5, pp. 397–401, (1986), Dejesus et al.
Radiation Research, vol. 79, (1979), pp. 22–33, Tilbury et al.
Appl. Radiat. Isot. vol. 41, No. 1, pp. 29–34, (1990), Chaly et al.
Appl. Radiat. Isot., vol. 41, No. 12, (1990), pp. 1193–1199, Mulholland et al. (I).
J. of Nuclear Medicine, vol. 30, No. 5, (Abstract Book—Proc. of the 36th Annual Meeting), (May 1989), p. 926, Abstract No. 838, Mulholland et al (II).
Inter. J. Applied Radiat. and Isotopes, vol. 24, (1973), pp. 124–126, Lindner et al (I).
Inter. J. Applied Radiat. and Isotopes, vol. 30, No. 8 (1979), pp. 506–507, Lindner et al (II).
Appl. Radiat. Isot., vol. 38, No. 11, (1987), pp. 979–984, Iwata et al.
Appl. Radiat. Isot., vol. 40, No. 8, pp. 663–669, (1989), Heselius et al.
Int. J. Appl. Radiat. & Isot., vol. 26, No. 5, May 1975, pp. 316–318, Vaalburg et al.
Appl. Radiat. Isot., vol. 39, No. 10, (1988) pp. 1065–1071, Solin et al.
Seventh International Symp. on Radiopharm. Chem., Jul. 1988, Groningen, The Netherlands, pp. 192, 193, Mulholland et al (III).

*Primary Examiner*—Harvey E. Behrend
*Attorney, Agent, or Firm*—Sughrue, Mion, Zinn, Macpeak & Seas

[57] ABSTRACT

A process for the synthesis of $^{13}$N-ammonia in target which comprises charging target water and hydrogen into a synthesis apparatus to make a pressurized condition at 0.1–5 kg/cm$^2$ and irradiating proton beam to the target water which is circulated to produce $^{13}$N-ammonia, a process for the synthesis of $^{13}$N-ammonia in target which comprises bringing the target water containing $^{13}$N-ammonia thus produced into contact with a Na type cation-exchange resin to collect $^{13}$N-ammonia by the cation-exchange, and then bringing the cation-exchange resin into contact with a saline solution to elute the collected $^{13}$N-ammonia into the saline solution, and a process for the synthesis of a labeled compound, at the time of sucking a prescribed amount of the liquid of the target water, saline solution or the like into a syringe and injecting the liquid from the syringe into the above vessel, comprising depressing the piston of the syringe in the state that the pipe connecting the syringe and the vessel has been once closed to detect the displacement of the piston, and in the case that the displacement exceeds a prescribed value, judging that the sucked amount of the liquid into the syringe is short, on the other hand in the case that the displacement is not more than the prescribed value, opening said pipe to inject the liquid into the vessel.

The method of the invention can synthesize high purity $^{13}$N-ammonia in a short time which is suitable for the PET (Positron Emission Tomography) system which is a kind of tomography utilized for the dragnosis of disease, etc.

3 Claims, 3 Drawing Sheets

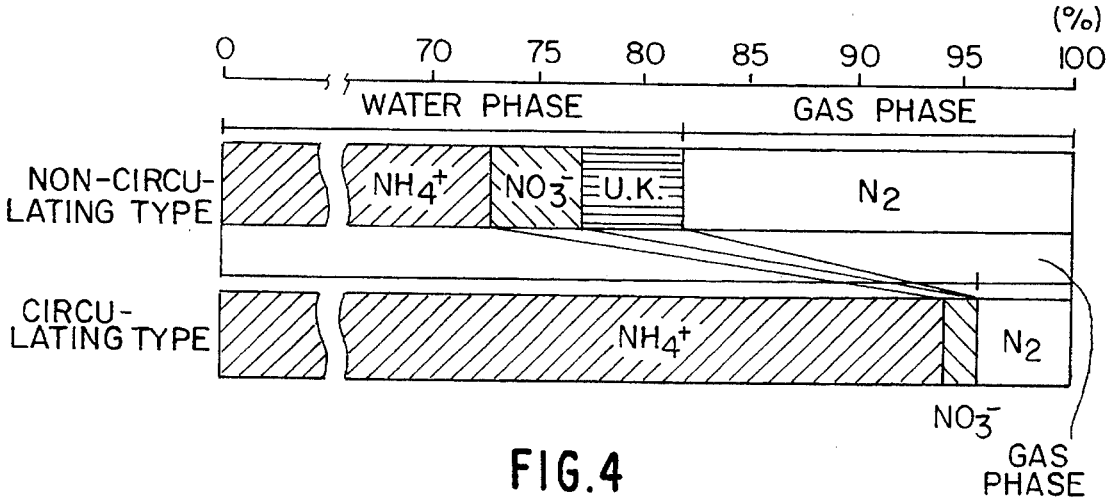
FIG.4
FIG.5
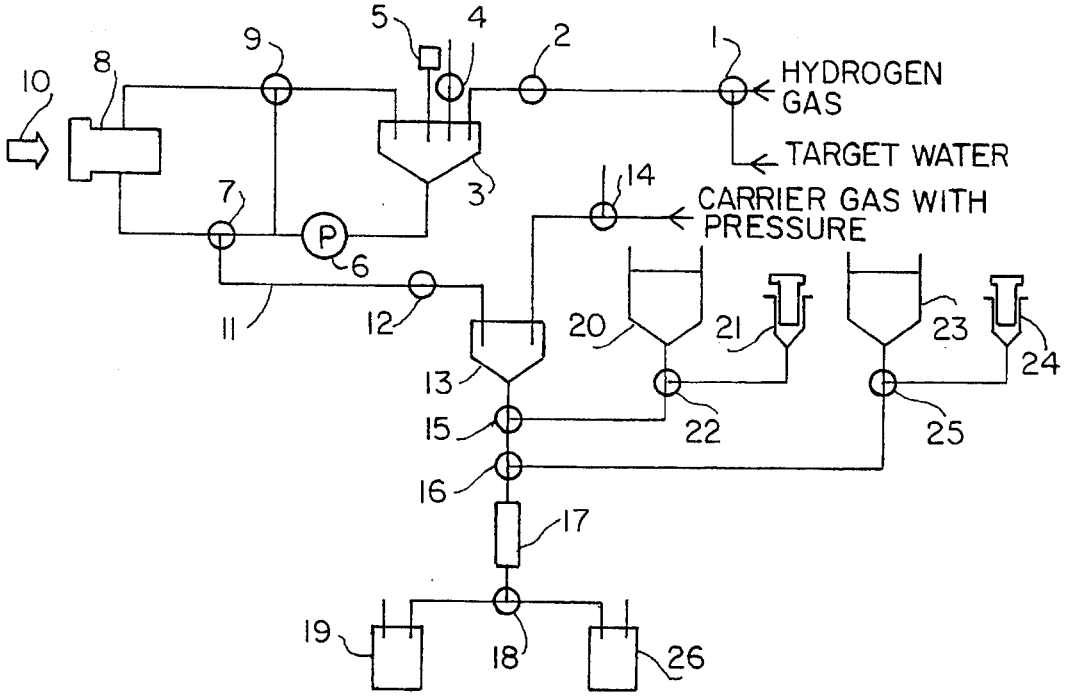

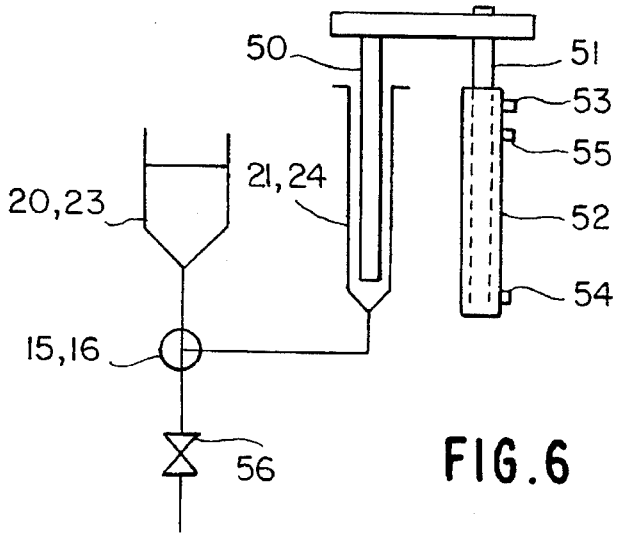
FIG.6
FIG.7
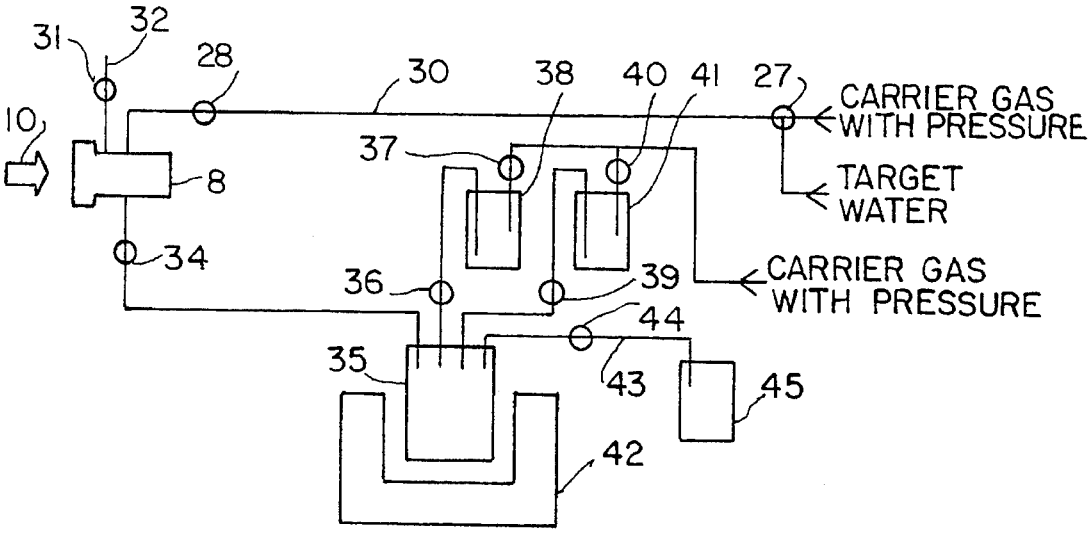

SYNTHESIS OF LABELED COMPOUND

This is a continuation of application Ser. No. 07/955,749, filed as PCT/JP92/00003 Jan. 7, 1992, now abandoned.

TECHNICAL FIELD

This invention relates to a synthesis of, for example, $^{13}$N-ammonia which is a labeled compound used in the PET system, or the like.

BACKGROUND ART

The PET (Position Emission Tomography) is utilized as a method of diagnosing the diseased part by injecting a emission radioactive isotope into the body of a patient and measuring α-rays emitted from positron released from the isotope to determine the distribution of the radioactive isotope at each slice. As the synthesis of the radioactive isotope, for example, a synthesis of pyruvate-1-$^{11}$C is disclosed in Japanese Patent KOKAI No. 1-294639. In this method, $^{11}CO_2$ is produced by a cyclotron, and the exchange reaction occurs between the $^{11}CO_2$ and non-radioactive pyruvate. In the synthesis, syringes are utilized for the injection of NaOH, transfer of a substrate solution and the like, but it is not disclosed at all to check whether these reagent solutions are sufficiently sucked into the syringe or not.

As the producing technique of $^{13}$N-ammonia, it is known to use the apparatus shown in FIG. 7 (RADIOISOTOPES, vol. 30, pp 1–6, 1981). In the method of producing $^{13}$N-ammonia using the apparatus, a fixed amount of target water is charged into an irradiation cell 8 through a three way cock 27 and a two way cock 28. Subsequently, the cock 27 is changed over, the whole amount of the target water remaining in a liquid feed pipe 30 is put into the irradiation cell 8 by using pressurized helium gas or nitrogen gas as the carrier gas. At that time, the carrier gas is discharged from pipe 32 by opening cock 31. Then, cock 27, cock 28 and cock 31 are closed, and when proton beam is irradiated, oxygen atoms in the target water reacts to produce $^{13}$N through nuclear reaction. The nitrogen atoms react with surrounding oxygen atoms to produce $^{13}$N-nitrate ions ($^{13}N—NO_3^-$). Subsequently, the target water to which the irradiation is finished is put into reaction vessel 35 by opening cock 34 and then cock 27 and cock 28. Then, reagent $TiCl_3$ in vial 38 is put into the reaction vessel 35 by opening cock 36 and cock 37. Reagent NaOH in vial 41 is further put into the reaction vessel 35 by opening cock 39 and cock 40. Subsequently, $^{13}$N-nitrate ions are allowed to react to be converted to $^{13}$-ammonia by heating the reaction vessel by heater 42. The ammonia is recovered into vial 45 through pipe 43 by distillation. In the past, $^{13}$N-ammonia was produced as stated above. Since water was also distilled and condensed in the vial 45, an isotonic liquid usable for injection was obtained by measuring the amount of the water therein and adding sodium chloride which was weighed according to the amount. It is not disclosed to utilize a syringe for the injection of liquid in the apparatus.

In the above producing method of $^{13}$N-ammonia, since $^{13}$N-nitrate ion is converted to $^{13}$N-ammonia, distilled and then purified it, a long time is necessary for obtaining it. Particularly, heating takes time due to distillation operation. As a result, more than 10 minutes are necessary from the end of the irradiation to taking out the produced $^{13}$N-ammonia into the vial 45. Since the half lifetime of $^{13}$N- is short, i.e. 9.96 minutes, about a half of $^{13}$N was lost by the decay in the meantime. Besides, since sodium chloride was weighed and added separately, it was also a problem that the operation was complex and troublesome and that the sodium chloride concentration was scattered.

Incidentally, as the means to charge a constant amount of a reagent solution or the like into a separate container automatically, there are the syringe method and the vial method. In the syringe method, a necessary amount of liquid is previously put in a syringe, and at the time of need, the piston of the syringe is depressed to charge it, and the method is disclosed in RADIOISOTOPE, vol. 33, pp 706–709, 1984, Eizo Joho (Image Information), 3, 1981, etc. In the vial method, a necessary amount of liquid is previously put in a vial, and at the time of need, the whole amount is delivered by pressurized He, $N_2$, etc. gas, and the method is disclosed in Int. Appl. Radiat. Isot., vol. 36, No. 6, pp 469–474, 1985, ibid., vol. 35, No. 6, pp 445–454, 1984, etc.

In the syringe method, when liquid is sucked into the syringe, if there is clogging in the pipe, defective connection of the pipe, breakage of the pipe or the like, the sucked amount of the liquid into the syringe is short. In the conventional automatic synthesis apparatus, the procedure automatically proceeded to the next process even in such a case, and troubles occurred, because of lacking any checking function thereof. Furthermore, waiting for a certain period is necessary at the time of sucking the liquid into the syringe. Besides, even in the case of using the same liquid, vials or syrings as many as the number of using it must be set, irrespective of the vial method or the syringe method.

The present invention has been achieved in order to solve the above problems, and an object of the invention is to provide a method capable of synthesizing $^{13}$N-ammonia in a short time by lasy operations.

Another object of the invention is to provide a means capable of preventing troubles by checking whether the necessary amount of liquid has been sucked into the syringe or not.

A further object of the invention is to provide a means capable of preventing troubles by checking whether the necessary amount of liquid has been sucked into the syringe or not.

A further object of the invention is to provide a means capable of omitting the waiting time at the time of sucking into the syringe and operating in a short time. This invention is particularly effective in the case of using a radioactive isotope having a short half lifetime, such as $^{13}$N.

DISCLOSURE OF INVENTION

The above objects have been achieved by a process for the synthesis of $^{13}$N-ammonia in target which comprises charging target water and hydrogen into a synthesis apparatus to make a pressurized condition at 0.1–5 kg/cm$^2$ and irradiating proton beam to the circulating target water to produce $^{13}$N-ammonia.

The above objects have also been acieved by a process for the synthesis of $^{13}$N-ammonia in target which comprises bringing target water containing $^{13}$N-ammonia produced by charging target water and hydrogen and irradiating proton beam into contact with a Na-type cation-exchange resin to collect $^{13}$N-ammonia by the cation-exchange, and then bringing the cation-exchange resin into contact with a saline solution to elute the collected $^{13}$N-ammonia into the saline solution.

The above objects further have been achieved by a process for the synthesis of a labeled compound containing a process of injecting a liquid into a vessel which has characteristics as follows: At the time of sucking a prescribed amount of the liquid from a tank thereof into a syringe and injecting the liquid from the syringe into said vessel, the piston of the syringe is depressed in the state that the pipe connecting the syringe with the vessel has been once closed to detect the displacement of the piston. In the case that the displacement exceeds a prescribed value, the sucked amount of the liquid into the syringe is judged being short. On the other hand, in the case that the displacement is not more than the prescribed value, the pipe is opened to inject the liquid into the vessel.

BRIEF DESCRIPTION OF DRAWINGS

FIG. 4 is a bar gaph indicating the $^{13}$N distribution of the products obtained in Example 1 in comparison with the $^{13}$N distribution of the products which were obtained without circulation of target water.

FIG. 5 is a flow sheet illustrating an outline of the apparatus used in Example 2.

FIG. 6 is a detail view of the part of the liquid supply to the cation-exchange resin column in the apparatus of FIG. 5.

FIG. 7 is a flow sheet illustrating an outline of an apparatus used in the conventional synthesis.

BEST MODE FOR CARRYING OUT THE INVENTION

Figure 1:
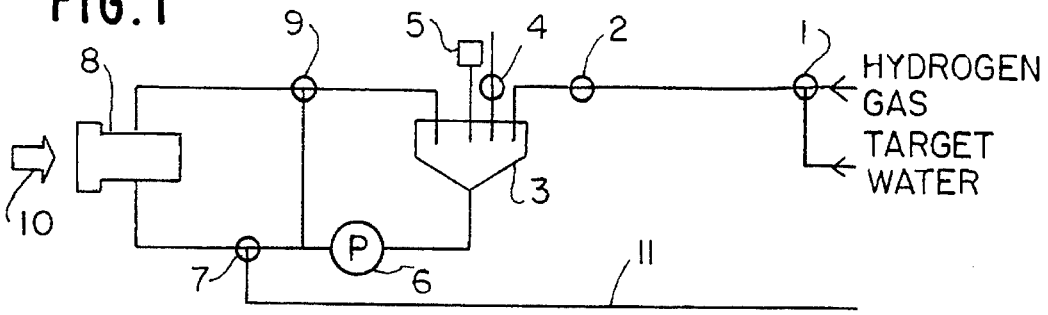
FIG. 1 is a flow sheet illustrating an outline of the target box used in Example 1 of the invention.

The apparatus used in the process for the synthesis of the invention has an irradiation cell wherein proton beam is irradiated to target water, an intermediate vessel to receive the target water, a circulating line to circulate the target water between both, and a liquid delivery pump provided at the circulating line, and a hydrogen gas supply pipe which is connected with the intermediate vessel. In addition, it is preferable that the apparatus is connected with a target water supply pipe and a discharge pipe of $^{13}$N-ammonia water which is the reaction product. Target water and hydrogen are charged into the above apparatus.

The target water is for the production of $^{13}$N-ammonia water by irradiating proton beam, and the purified water such as pure water or distilled water is usually used. In the case of using $^{13}$N-ammonia as an injection, it is preferable to use germfree water. The amount of the target water which can be used is determined according to the capacity of the synthesis apparatus, etc. That is, an amount capable of preventing the inflow of hydrogen gas into the circulating line is at least necessary, and the upper limit is determined so as to keep a hydrogen gas space capable of maintaining the target water in reducing atmosphere by the hydrogen gas.

The hydrogen is used in order to keep the target water in reducing atmosphere so as to produce ammonia. Although the volume ratio of the hydrogen gas to the target water is applicable in a wide range, for example, about 1:10 to 10:1 is suitable.

The target water and hydrogen are pressurized to about 0.1 to 5 kg/cm$^2$, preferably about 0.5 to 5 kg/cm$^2$, particularly preferably about 0.5 to 2 kg/cm$^2$. Less than 0.1 kg/cm$^2$ is not practical, because the production of ammonia is little. On the other hand, when 5 kg/cm$^2$ is exceeded, a synthesis apparatus having a high pressure resistance must be used.

The circulation of the target water may be in a speed capable of preventing the target water in the irradiation cell from changing into oxidizing atmosphere by the irradiation of proton beam and capable of removing bubbles formed in the irradiation cell to the degree not to interfere the reaction, and it is not necessary to be a greater speed than that.

The proton beam source and the quantity of the beam may be conventional as used generally for a synthesis apparatus for labeled compound, and conditions are set so as to obtain a most preferable beam quantity by considering the production efficiency of $^{13}$N-ammonia, etc. The irradiation time of proton beam is, in general, preferably near the point that $^{13}$N-ammonia concentration reaches the maximum concentration. However, since the lifetime of $^{13}$N-ammonia is short, the irradiation time is set taking into account the relationship to the product purity. When the circulation of the target water is conducted, either the irradiation of proton beam or the circulation of target water may be first started. However, unless there is a special object, the circulation of target water is started first.

In the above reaction, oxygen atom of water reacts with proton through nuclear reaction to produce $^{13}$N, and it is bound to surrounding hydrogen atoms to produce $^{13}$N-ammonia. In the above method, the target water is kept in reducing atmosphere by the coexistence of hydrogen in a pressurized state in the target water, and $^{13}$N-ammonia is directly produced from $^{13}$N produced through the decomposition of oxygen atom by the proton beam irradiation. The circulating target water prevents the target water from being in oxidizing atmosphere caused by the dissolution of oxygen atoms produced by the decomposition of water in the irradiation part, prevents irradiation efficiency from degrading by removing bubbles in the irradiation part.

After the irradiation, the target water can be used as it is according to the object of use, or, if necessary, it can be purified, e.g. the ammonia is evaporated by adding caustic alkali and then recovered.

However, it is preferable that the target water containing $^{13}$N-ammonia thus obtained is purified by contacting with a Na-type cation-exchange resin in Na type. As the cation-exchange resin, strongly acidic cation-exchange resins are suitable. The using amount of resin is sufficient that $^{13}$N-ammonia can be collected, and it may be about 0.1 to 0.5 ml (1.6 to 8 meq). As the method of contacting, the column method is suitable. After loading the resin in a column, if necessary, regeneration treatment to change the resin to Na type is conducted prior to use. The flow rate of the target water may be conventional. After charging the target water, the target water remaining in the resin layer is washed away by sterilized water or the like. Subsequently, a saline solution is charged to elute $^{13}$N-ammonia collected in the resin. The using amount of the saline solution may be about 5 to 20 ml, and the flow rate may be conventional. Since the resin which collected $^{13}$N-ammonia is regenerated to Na type by the elution, it can be reused as it is.

In the case of using $^{13}$N-ammonia as an injection, by sterilizing the inside of the apparatus, particularly the downstream side from the irradiation cell, the liquid eluted from cation-exchange resin by a saline solution can be used as the injection as it is.

In the above method, it is considered that, when the target water containing $^{13}$N-ammonia is contacted with the strongly acidic Na type cation-exchange resin a part of $Na^+$ is released from the cation-exchange resin by equilibrium, and $^{13}$N-ammonia is adsorbed there by ion-exchange. Subsequently, the saline solution is contacted with resin to induce ion-exchange between $Na^+$ and $^{13}$N-ammonia, and $^{13}$N-ammonia is eluted.

In the process for the synthesis, a constant amount of liquid can be surely delivered by using syringe in injecting the liquid into a vessel every time. The syringe is connected to a tank of the liquid through a pipe, and a prescribed amount of the liquid is sucked from the tank. A power source such as motor or compressed air is provided, and the motion of the piston of the syringe is conducted by its drive. Accordingly, it is necessary a mechanism which sets a Start point and a stop point and commands to start or stop there. If necessary, the start point and the stop point are variable. As the means to detect the start point and the stop point, knwon ones may be utilized, and for example, the passage of a specific part, such as the piston itself or a piston rod connecting it with a driving source, may be detected by a sensor, a switch or the like. The driving mechanism of the syringe is arranged not to break the syringe and the synthesis apparatus by stopping the during of syringe when the pressure in the syringe exceeds a definite value.

Subsequently, when the liquid is injected from the syringe to the above vessel, the pipe connecting the syringe and the vessel is closed once. As the means of closing the pipe, a valve provided at the pipe may be closed, and if necessary, the number of valves may be increased therefor. In the case that the pipe is formed of a soft material, the valve may be in a pinching type. In the state that the pipe is closed, the driving source of the piston is drived to depress the piston, and the displacement is detected. As the detecting measns, a sensor, switch or the like may be used, and arranged so that a prescribed value can be detected. The displacement is the moved distance of the piston. Then, when the displacement exceeds the prescribed value, it is judged that the sucked amount of the liquid into the syringe is short. On the other hand, when it is not more than the prescribed value, the above pipe is opened to inject the liquid into the vessel. The above prescribed value which is a criterion of the judgement varies by the object of the use of the liquid, the allowable amount of gases in the syringe at normal operation, the depressing pressure of the piston, and the like, and it is set taking into account them. When it is judged that the sucked amount into the syringe is short, motions, such as sounding an alarm and stopping the apparatus, are rendered to be done.

In the above method, a constant amount of liquid can be surely injected into the vessel by sucking the liquid into the syringe each time. Then, when the piston of the syringe is depressed in a state that the pipe connecting the syringe and the vessel is closed, if there is clogging in the pipe or an insufficient suction of the liquid, the displacement of the depression increases due that the inside of the syringe becomes into a reduced pressure condition at the time of suction. If there is defective connection of the pipe or breakage of the pipe, the displacement occurs by the compression of gases at the time of depression due that outside air is sucked and accumulated in the syringe. When defective connection or breakage exists between the three way valve and the syringe, the displacement further increases due that the liquid escapes out of the pipe at the time of depression. Thereupon, the abnormality of sucked amount of the liquid is detected by measuring the displacement, and a countermeasure can be taken.

The above method is not limited to the synthesis of $^{13}$N-ammonia but is applicable to the synthesis of compounds labeled with other isotopes. The kind of the liquid is not limited, but includes acids, alkalis, substrate solutions, washing solution and eluting agent solutions and the like according to the kind of the synthetic reaction, etc.

The vessel to which the liquid is injected is also not particularly limited, and its form, size, sealability or the like is selected according to the use or the like.

As mentioned above, according to the invention, $^{13}$N-ammonia can be directly produced in the target box by pressurizing the target water by hydrogen to 0.1 to 5 kg/cm$^2$ and irradiating while circulating by a pump, and $^{13}$N-ammonia can be obtained stably. Furthermore, by-products are little, and $^{13}$N-ammonia can be obtained in a high purity and in a short time through simple operations. Since nuclear reaction is allowed to occur in the target water which has been rendered in reducing atmosphere by hydrogen, $^{13}$N-ammonia can be directly produced in the target water. By purifying the $^{13}$N-ammonia by a strongly acidic Na type cation-exchange resin, the ammonia can be obtained in a state available for injection as it is. Furthermore, by adding a sensor valve capable of detecting the displacement of the syringe and thereby rendering to check whether the liquid is sufficiently charged in the syringe or not, troubles in the liquid injection apparatus can be prevented.

EXAMPLES

Example 1

FIG. 1 is a flow sheet illustrating an outline of the target box used in Example of the invention. As the method of producing aqueous ammonia of 13 nitrogen by using the apparatus, first, a constant amount of water (target water) which is a target material is delivered into an intermediate vessel 3 through a three way cock 1 and a two way cock 2. Thereby, the circulating line is filled with water, and gases in the system is collected into the intermediate vessel 3. Subsequently, cock 1 is changed over, and the whole amount of the target water remaining the liquid feed pipe is delivered by hydrogen gas to the intermediate vessel, and well as gases remaining in the intermediate vessel 3 are purged by the hydrogen gas. The purged gases are discharged to the outside through cock 4. Subsequently, cock 4 is closed, and the inside of the target box is pressurized by hydrogen gas to a necessary pressure while pressure is measured by a pressure gauge 5. Cock 1 and cock 2 are closed. Then, liquid delivery pump 6 is maneuvered to circulate the target water in the intermediate vessel 3 through cock 7, irradiation cell 8 and cock 9 to return to the intermediate vessel 3. In this state, when proton beam 10 is irradiated, nuclear reaction occurs in oxygen atoms in the target water to produce $^{13}$N. The nitrogen atom reacts with hydrogen atoms to produce $^{13}$N-ammonia in the target water. After the end of irradiation, aqueous $^{13}$N-ammonia is taken out of the target box through pipe 11 by changing cock 7 and cock 9 over and opening cock 1 and cock 2.

According to the above method, aqueous $^{13}$N-ammonia was produced with varying hydrogen pressure. Producing conditions are shown below.

Internal volume of target box: 7 ml

Amount of target water: 3–5 ml

Circulating speed: 100 ml/min.

Irradiation time: 10 min.

Irradiated particle: Proton 12 MeV

Irradiation current: approx. 15 μA

Figure 2:
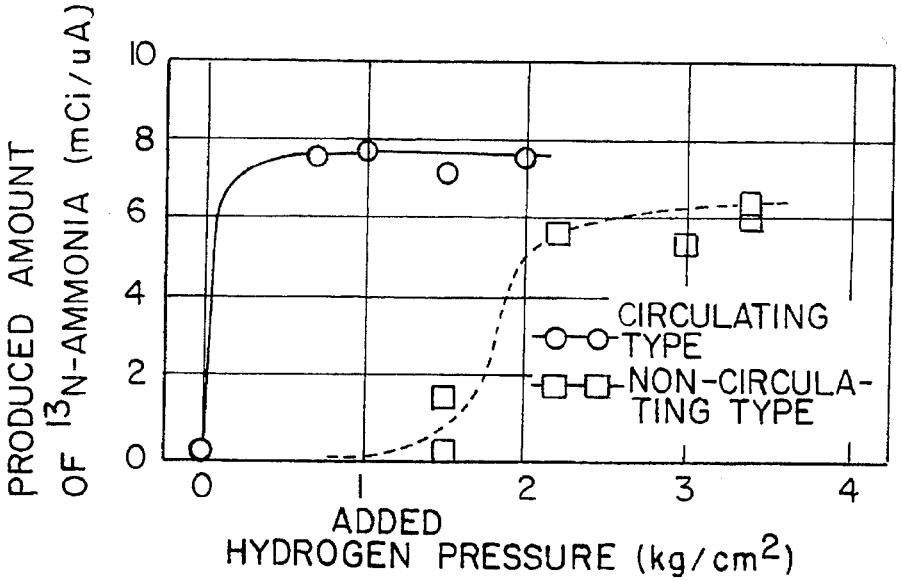
FIG. 2 is a graph indicating the relationship between the produced amount of $^{13}$N-ammonia and charged hydrogen pressure obtained in Example 1.
Figure 3:
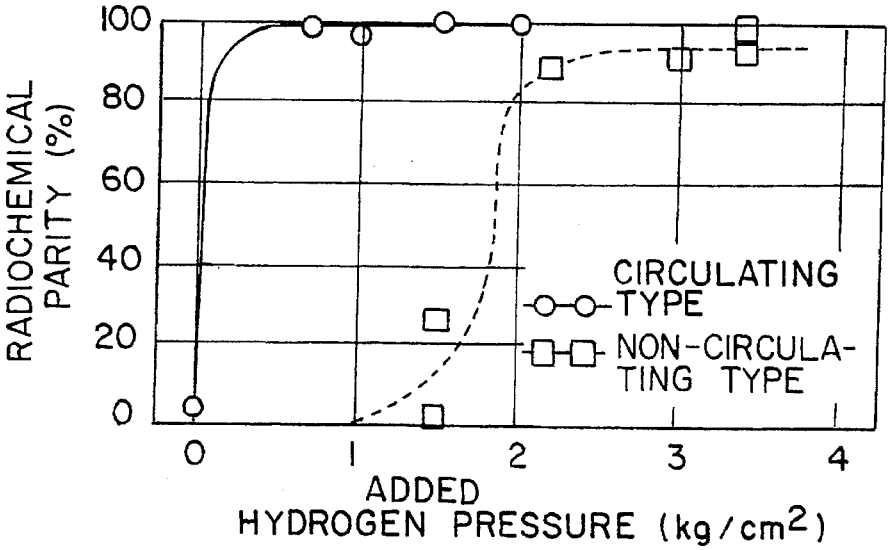
FIG. 3 is a graph indicating the relationship between the radiochemical purity of $^{13}$N-ammonia and charged hydrogen pressure obtained in Example 1.

The results obtained are shown in FIG. 2 and FIG. 3. FIG. 2 is the graph indicating the relationship between hydrogen pressure and the produced amount of $^{13}$N-ammonia, and FIG. 3 is the graph indicating the relationship between hydrogen pressure and the radiochemical purity of the produced $^{13}$N-ammonia. In both figures, symbol ○ indicates the results of the experiment which was conducted in the circulating type by maneuvering the circulation pump, and symbol indicates the results of the experiment which was conducted in the non-circulating type withou maneuvering the circulating pump. As shown in these figures, in the case of the circulating type, a sufficient amount of ammonia and radiochemical purity is obtained around 0.1 kg/cm$^2$ and they reach almost saturated state around 0.5 kg/cm$^2$. On the other hand, in the case of the non-circulating type, the hydrogen pressure beyond 2 kg/cm$^2$ is necessary in order to reach a saturated state, and the produced amount and the radiochemical purity are less than that of the circulating type.

The produced amount of ammonia was determined by measuring the radioactivity of $^{13}$N using a radiation meter. The radiochemical purity was determined by analyzing the target water after the end of the irradiation using a high performance liquid chromatography.

Subsequently, the hydrogen pressure of the circulating type was set at 0.7 kg/cm$^2$ and that of the non-circulating type was set at 2.2 kg/cm$^2$ and ammonia synthesis was conducted similarly. The distribution of $^{13}$N of the products were measured, and the results are shown in FIG. 4. As shown in the figure, in the case of the circulating type, approx. 95% of the produced radioactivity was taken out in the chemical form of $^{13}$N—$NH_4^+$. Whereas, in the non-circulating type, it was about 73%, and it was found that by-products, such as $^{13}$N—$NO_3^-$, unidentified materials in water and $^{13}$N—$N_2$ were produced.

As the analytical method of the above components, at the time of recovering the target water after the finish of irradiation, gases were simultaneously recovered into a balloon and each radioactivity was measured. As the water, the components were analyzed by a high speed liquid chromatography.

Example 2

FIG. 5 is a flow sheet illustrating an outline of the apparatus used in Example of the invention. As the method of manufacturing aqueous ammonia of 13 nitrogen for an injection using the apparatus, until $^{13}$N-ammonia is produced by irradiating proton beam 10, it is maneuvered similar to Example 1.

After the finish of irradiation, the target water containing $^{13}$N-ammonia is taken out of the target box through pipe 11 by changing cock 7 and cock 9 over and opening cock 1 and cock 2, and put into the intermediate vessel 13 through two way cock 12. Subsequently, carrier gas with pressure is charged by opening cock 14, and the $^{13}$N-ammonia is delivered from the target water containing intermediate vessel 13 to cation-exchange resin column 17 by opening cocks 15, 16 and 18. The waste liquid which passed the column is put into waste liquid vessel 19. At that time, only $^{13}$N-ammonia is collected by the cation-exchange resin. A constant amount of germfree water is sucked from germfree water vessel 20 by syringe 21, and the germfree water is streamed into the cation-exchange resin column 17 by changing three way cocks 22 and 15, and thereby, all of the target water remaining in the resin layer is washed out. Washed waste liquid is put into the waste liquid vessel 19. Subsequently, a constant amount of saline solution is sucked from saline solution vessel 23 by syringe 24, and the saline solution flows into the cation-exchange resin column by changing three way cocks 25, 16 and 18. Thereby, $^{13}$N-ammonia collected by the cation-exchange resin is eluted, and entered into $^{13}$N-ammonia solution vessel 26 together with the saline solution.

Using the above method, aqueous $^{13}$N-ammonia was produced with varying hydrogen pressure. Producing conditions are shown below.

Internal volume of target box: 7 ml

Amount of target water: 3–5 ml

Hydrogen pressure: 0.7 kg/cm$^2$

Circulating speed: 100 ml/min.

Irradiation time: 10 min.

Irradiated particle: proton 12 MeV

Irradiation current: approx. 15 μA

Ion-exchange resin: strongly acidic cation-exchange resin in Na type (Sep Cartridge IC-H) 0.5 ml Amount of washing water: 3 ml Amount of saline solution: 10 ml The yield and purity are as follows:

| | Produced Amount of $^{13}$N-Ammonia (mCi/μA) | Radiochemical Parity (%) |
|---|---|---|
| Irradiation Cell Exit | 7.5 | 99.4 |
| $^{13}$N-Ammonia Solution Vessel | ≧4.5 | ≧22 99.9 |

The produced amount of ammonia was determined by measuring the radioactivity of $^{13}$N using a radiation meter. The radiochemical purity was determined by analyzing the target water after the end of irradiation using a high performance liquid chromatography.

Example 3

In the apparatus used in Example 2, as shown in FIG. 6, piston rod 51 in L-form was attached to the piston 50 of syringes 21 and 24. Upper detecting sensor 53 and lower detecting sensor 54 were provided to detect the position of piston rod 51 in driving apparatus 52, and piston rod detecting sensor 55 was further provided slightly under the upper detecting sensor 53. Two way value 56 was provided under the three way valves 15, 16. When the apparatus is maneuvered, the piston rod 51 of which the lower end is positioned at the lowest portion by the instruction of the sensor 54 starts to ascend by the driving apparatus 52, and the liquid in vessels 20, 23 were sucked into syringes 21, 24 through the three way valves 15, 16. When the lower end of the piston rod is detected by the upper detecting sensor 53, the piston rod is stopped. Subsequently, after changing the three way valves 15, 16 over and closing the valve 56, the driving apparatus 52 is maneuvered in the direction to depress the piston rod. When the lower end of the piston rod is detected by the piston rod detecting sensor 55, it is judged that the sucked amount is short. Then, the apparatus is stopped, and check is conducted. On the other hand, the lower end of the piston rod is not detected by the piston rod detecting sensor 55, the liquid is fed to the cation-exchange column 17 by opening the valve 56. When the lower end of the piston rod is detected by the lower detecting sensor 54, the driving apparatus 52 is stopped to finish the feeding of liquid.

Aqueous $^{13}$N-ammonia was produced with varying hydrogen pressure in the same way as Example 2 except that the above syringes were used. The producing conditions are shown below.

Internal volume of target box: 7 ml

Amount of target water: 3–5 ml

Hydrogen pressure: 0.7 kg/cm$^2$

Circulating speed: 100 ml/min.

Irradiation time: 10 min.

Irradiated particle: Proton 12 MeV

Irradiation current: approx. 15 μA

Ion-exchange resin: strongly acidic cation-exchange resin in Na type (Sep Cartridge IC-H) 0.5 ml Amount of washing water: 3 ml Amount of saline solution: 10 ml The yield and purity are as follows:

| | Produced Amount of $^{13}$N-Ammonia (mCi/μA) | Radiochemical Parity (%) |
|---|---|---|
| Irradiation Cell Exit | 7.5 | 99.4 |
| $^{13}$N-Ammonia Solution Vessel | ≧4.5 | ≧99.9 |

The produced amount of ammonia was determined by measuring the radioactivity of $^{13}$N using a radiation meter. The radiochemical purity was determined by analyzing the target water after the end of irradiation using a high performance liquid chromatography.

The synthesis of $^{13}$N-ammonia which was stated above was repeated. When the valve 56 was closed and then the piston rod 51 was depressed, the lower end of the piston rod was detected by the piston rod detecting sensor 55. Thereupon, the synthesis apparatus was checked, and it was found that clogging occurred in the pipe and the sucked amount was short by 10 to 20% of the specified amount.

INDUSTRIAL APPLICABILITY

According to the method of the invention, since a compound labeled with an isotope such as $^{13}$N-ammonia can be synthesized efficiently in a short time, it is suitable as the synthesis of an injection for PET system.

We claim:

1. A process for the synthesis of $^{13}$N-ammonia in a target system, in a synthesis apparatus comprising:

circulating target water in said target system;

charging hydrogen into said synthesis apparatus to create a pressurized condition of 0.5 to 2 kg/cm$^2$ to maintain the target water in a reducing atmosphere;

wherein said circulating is conducted continuously at a speed to prevent the target water in an irradiation cell from changing into an oxidizing atmosphere upon irradiation of a proton beam; and irradiating said target water with a proton beam to produce $^{13}$N-ammonia having a radiochemical purity of 95% or more.

2. The process for the synthesis of $^{13}$N-ammonia in a target system, in a synthesis apparatus according to claim 1 further comprising:

purifying target water containing $^{13}$N-ammonia by contacting said target water containing said $^{13}$N-ammonia with a Na-type cation-exchange resin to collect the $^{13}$N-ammonia, and charging a saline solution to elute the $^{13}$N-ammonia collected.

3. The process of claim 1 wherein the amount of target water used provides a hydrogen gas space which maintains the target water in a reducing atmosphere.

* * * * *